US005354061A

United States Patent [19]

Gubany

[11] Patent Number: 5,354,061

[45] Date of Patent: Oct. 11, 1994

[54] YARD-GOLF GAME APPARATUS

[75] Inventor: Peter M. Gubany, St. Louis, Mo.

[73] Assignee: Leisure Master Incorporated, St. Louis, Mo.

[21] Appl. No.: 63,243

[22] Filed: May 18, 1993

[51] Int. Cl.[5] ..... A63B 69/36

[52] U.S. Cl. ..... 273/178 R

[58] Field of Search ..... 273/178 R, 178 A, 178 B, 273/180, 177 A, 177 B, 176 B

[56] References Cited

U.S. PATENT DOCUMENTS

| | | | |
|---|---|---|---|
| 2,121,270 | 6/1938 | Streich | 273/180 |
| 2,283,462 | 5/1942 | Richie | 273/178 A |
| 3,797,833 | 3/1974 | Rokusek | 273/178 R |
| 4,359,225 | 11/1982 | Baldorossi et al. | 273/178 A |
| 4,878,671 | 11/1989 | Gubany | 273/176 R |
| 4,906,006 | 3/1990 | Sigunick | 273/178 R |
| 5,230,511 | 7/1993 | Gubany | 273/178 R |

*Primary Examiner*—George J. Marlo
*Attorney, Agent, or Firm*—Armstrong, Teasdale, Schlafly & Davis

[57] ABSTRACT

A hole apparatus adapted to be secured on a lawn to simulate a hole for a yard-golf game includes a ring having a frustoconical surface with a generally central opening for receiving a ball. There are a plurality of teeth on the perimeter of the ring for gripping the lawn and holding the outer edge of the ring against the lawn to provide a smooth transition between the lawn and the apparatus for a ball to roll from the lawn up the surface of the ring and into the opening.

11 Claims, 1 Drawing Sheet

YARD-GOLF GAME APPARATUS

BACKGROUND OF THE INVENTION

This invention relates to equipment for playing a yard-golftype game.

The inventor's prior U.S. Pat. No. 4,878,671, discloses a yard-golf game apparatus that provided a golf "hole" for a yard-golf-type game that did not require a hole to be dug in the yard. This apparatus had many advantages, including providing a hole with a smooth approach so that a ball could be easily hit into the hole.

The inventor's prior application Ser. No. 07/952,311, filed Sep. 28, 1992, now U.S. Pat. No. 5,230,511, discloses a yard-golf game apparatus that likewise provided a golf "hole" for a yard-golf type game that did not require a hole to be dug in the yard. This apparatus provides an annular ball-receiving space with converging walls that trap a ball hit into the space, reducing the incidence of the ball bouncing out of the cup. Moreover, the apparatus could be easily adapted to make the game more difficult, to provide greater challenge, or to accommodate players of differing abilities.

The present invention also relates to a yard-golf game apparatus for providing a golf "hole" for a yard-golf game. The apparatus is very light weight and compact and inexpensive to manufacture. The apparatus does not require any additional parts or equipment to install or secure the apparatus. However, the apparatus can be firmly secured to the lawn to provide a smooth transition from the lawn to the apparatus so that a ball can roll smoothly from the lawn up the apparatus, and into an opening forming the "hole".

Generally, the yard-golf game apparatus of the present invention comprises a ring having a frusto-conical surface with a generally central opening for receiving a ball. There are a plurality of teeth on the perimeter of the ring for gripping the lawn and holding the outer edge of the ring against the lawn to provide a smooth transition between the lawn and the apparatus, so that a ball can roll smoothly from the lawn up the frustoconical surface, and into the opening.

The teeth preferably extend generally counterclockwise of the ring, at an angle between the radial and circumferential directions with respect to the ring, so that the apparatus can be twisted or "screwed" into the lawn, with the teeth engaging the grass. The teeth preferably have a generally triangular shape, tapering from their bases to their tips, and the tips are preferably bent downwardly from the frusto-conical surface to facilitate gripping the lawn.

The apparatus is very compact and light weight. It can be inexpensively made out of plastic by vacuum forming or injection molding. The apparatus can be nested for convenient storage and transportation. The teeth easily removably secure the apparatus to a lawn, without the need for additional parts. In the preferred embodiment there is no cup in the opening, which saves material, reduces the weight of the device, and allows a ball to fall to the lawn, which absorbs the impact, and reduces the chances of the ball bouncing out.

These and other features and advantages of the invention will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
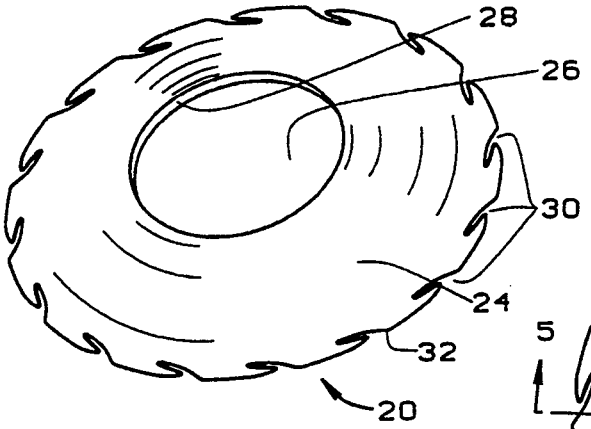
FIG. 1 is a perspective view of a yard-golf game apparatus constructed according to the principles of this invention.
Figure 2:
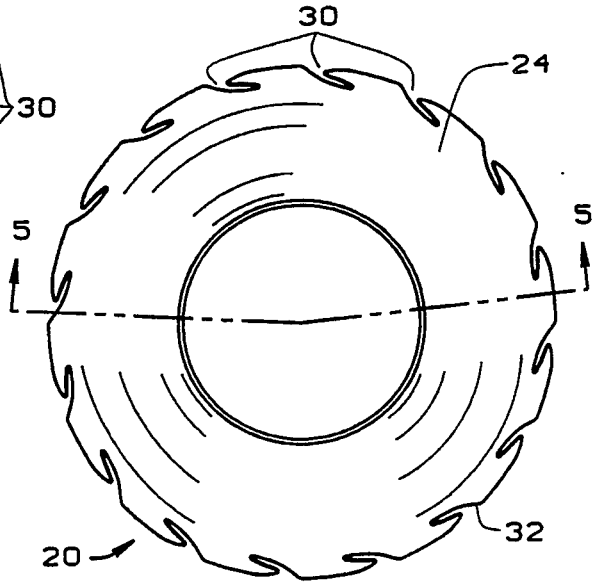
FIG. 2 is a top plan view of the apparatus.
Figure 3:
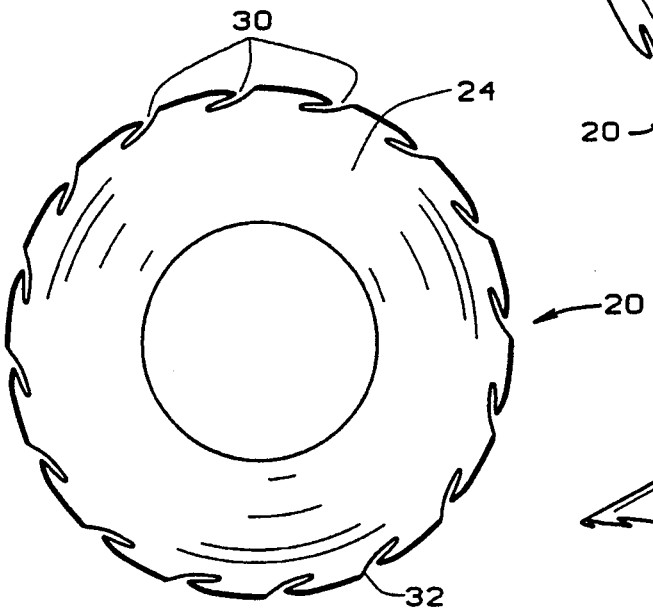
FIG. 3 is a bottom plan view of the apparatus.
Figure 4:
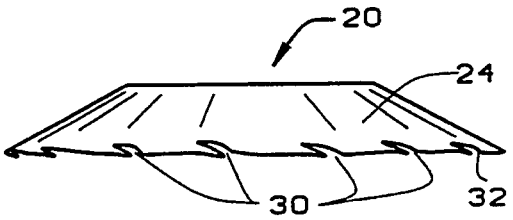
FIG. 4 is a side elevation view of the apparatus.
Figure 5:
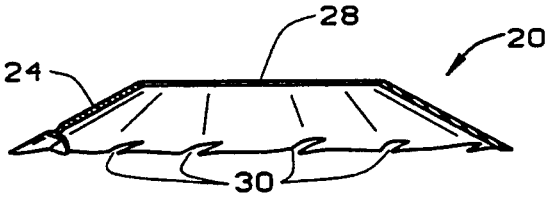
FIG. 5 is a vertical cross-sectional view of the apparatus taken along the plane of line 5—5 in FIG. 2.
Figure 6:
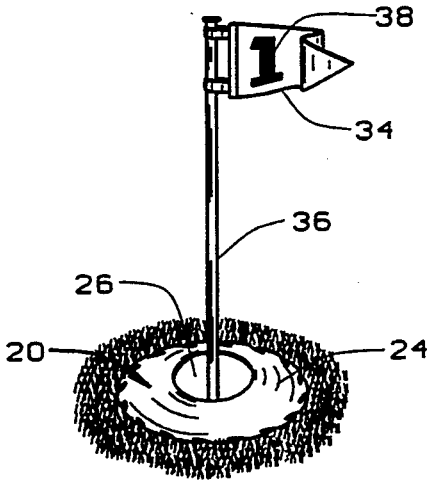
FIG. 6 is a perspective view of the apparatus as it would be set up on a lawn.

A yard-golf game apparatus constructed according to the principles of this invention is indicated generally as 20 in FIGS. 1–6. The apparatus 20 is adapted to be used with one or more clubs, which are used to hit a ball into the "hole" formed by the game apparatus 20. The apparatus 20 comprises a generally frusto-conical ring 24, having a generally central opening 26, defined by its inner edge 28. A cup (not shown) may be provided in the central opening to receive a ball struck into the opening 26. However, the apparatus is lighter and less expensive to manufacture without the cup. Moreover, without the cup, the ball drops to the ground, which can absorb the impact, and thus the ball is less likely to bounce out of the opening once it is properly hit into the opening.

There are a plurality of teeth 30 on the perimeter 32 of the ring 22 for gripping the lawn and holding the outer edge of the ring against the lawn to provide a smooth transition between the lawn and the apparatus for a ball to roll from the lawn up the surface of the ring and into the opening. The teeth 30 preferably have a generally triangular configuration, tapering from their bases to their tips. The tips of the teeth 30 are preferably bent downwardly from the frusto-conical surface of the ring so facilitate engaging the lawn. The ends of the tips are preferably rounded so that to reduce the possibility of cutting or scratching the use during transportation and use, but the teeth are sufficiently pointed to easily engage the lawn.

As shown in the Figures, the teeth point generally counterclockwise of the ring 24, extending at an angle between the radial rand circumferential directions with respect to the ring to define generally circumferentially elongated openings so that the teeth can be imbedded into a lawn by pressing the apparatus against the lawn, and rotating the apparatus counterclockwise. The teeth could, of course, be oriented in a clockwise direction, in which case the apparatus is turned clockwise to secure it to a lawn. The apparatus can be secured to the lawn without special tools or additional parts. The teeth 30 are preferably evenly spaced around the perimeter of the ring, sufficiently close to each other to hold the perimeter down so that a ball can roll smoothly up the ring.

The opening 26 allows air and sunlight to reach the grass under the apparatus 20, so that the apparatus can be left in place for extended periods without damaging the grass underneath it. A flag 34 on a pole 36 can be mounted in the ground beneath the opening to give the appearance of a real golf hole. The flag 34 can be made of a colored, reinforced, flexible paper, such as Tyrek ® and provided with hole numerals 38. The pole 36 made of wood, plastic coated metal, or some other suitable can be material.

The rings 22 are preferably nestable for convenience in transportation and storage.

OPERATION

In operation, the apparatus 20 is set up for play by placing the ring 24 in an appropriate location on a lawn in a yard or park. The ring 24 is pressed down firmly against the ground and rotated counterclockwise to allow the teeth 26 to engage the lawn, anchoring the apparatus and holding the outer edge down to provide a smooth transition between the lawn and the ring 24, so that a ball can roll smoothly from the lawn up the ring and into the opening 26. A flag 34 on a pole 36 can be can be pushed into the ground at the center of the opening.

Once installed, the apparatus is ready for use. When a ball is properly struck with club, it rolls up the surface of the ring 24, and falls into the opening 26. Because, in the preferred embodiment, there is no cup in the opening, a ball hit into the opening drops down and hits the ground, which deadens the impact, so that the ball is unlikely to bound back out of the opening.

Thus the invention provides a more pleasant and less frustrating game, that is inexpensive, light weight, and easy to transport and store.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A hole apparatus adapted to be secured on a lawn to simulate a hole for a yard-golf game, the apparatus comprising:

a ring having a frusto-conical surface with a generally central opening for receiving a ball, a plurality of teeth defining generally circumferentially elongated openings on the outer perimeter of the ring for gripping the lawn and holding the outer edge of the ring against the lawn upon rotation of said ring to provide a smooth transition between the lawn and the apparatus for a ball to roll from the lawn up the surface of the ring and into the opening.

2. The hole apparatus according to claim 1 wherein the teeth are generally triangular, tapering from their bases to their tips.

3. The hole apparatus according to claim 2 wherein the tips of the teeth extend downwardly from the frusto-conical surface.

4. The hole apparatus according to claim 1 wherein the teeth are spaced equally around the perimeter of the ring.

5. The hole apparatus according to claim 4 wherein there are at least 8 teeth.

6. The hole apparatus according to claim 1 wherein the teeth extend at an angle with respect to radial a direction.

7. A hole apparatus adapted to be secured on a lawn to simulate a hole for a yard-golf game, the apparatus comprising:

a ring having a frusto-conical surface with a generally central opening for receiving a ball, a plurality of teeth defining generally circumferentially elongated openings on the perimeter of the ring, extending at an angle between the circumferential and radial directions with respect to the ring, for gripping the lawn upon rotation of said ring and holding the outer edge of the ring against the lawn to provide a smooth transition between the lawn and the apparatus for a ball to roll from the lawn up the surface of the ring and into the opening.

8. The hole apparatus according to claim 7 wherein the teeth are generally triangular, tapering from their bases to their tips.

9. The hole apparatus according to claim 8 wherein the tips of the teeth extend downwardly from the frusto-conical surface.

10. The hole apparatus according to claim 8 wherein the teeth are spaced equally around the perimeter of the ring.

11. The hole apparatus according to claim 7 wherein there are at least 8 teeth.

* * * * *